US010421307B2

(12) United States Patent
Suzuki et al.

(10) Patent No.: US 10,421,307 B2
(45) Date of Patent: Sep. 24, 2019

(54) SHEET BINDING SYSTEM, IMAGE FORMING APPARATUS WITH SHEET BINDING SYSTEM, AND METHOD OF BINDING SHEET BUNDLE

(71) Applicants: Nobuyoshi Suzuki, Tokyo (JP); Yuusuke Shibasaki, Miyagi (JP); Wataru Takahashi, Tokyo (JP); Takuya Morinaga, Tokyo (JP); Koki Sakano, Kanagawa (JP)

(72) Inventors: Nobuyoshi Suzuki, Tokyo (JP); Yuusuke Shibasaki, Miyagi (JP); Wataru Takahashi, Tokyo (JP); Takuya Morinaga, Tokyo (JP); Koki Sakano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 90 days.

(21) Appl. No.: 15/423,689

(22) Filed: Feb. 3, 2017

(65) Prior Publication Data

US 2017/0217239 A1 Aug. 3, 2017

(30) Foreign Application Priority Data

Feb. 3, 2016 (JP) ..... 2016-018521

(51) Int. Cl.
*B65H 37/04* (2006.01)
*B42C 1/12* (2006.01)
(Continued)

(52) U.S. Cl.
CPC ..... *B42C 1/12* (2013.01); *B42C 19/08* (2013.01); *B65H 31/38* (2013.01); *B65H 37/04* (2013.01);
(Continued)

(58) Field of Classification Search
CPC .... B65H 2301/43828; B65H 2403/514; B65H 2301/51616
See application file for complete search history.

(56) References Cited

U.S. PATENT DOCUMENTS 8,596,633 B2 * 12/2013 Awaya ..... B65H 37/04 270/58.07
2013/0264762 A1 10/2013 Matsushita et al.
(Continued)

FOREIGN PATENT DOCUMENTS

JP 2010-274623 12/2010
JP 2010274623 A * 12/2010
(Continued)

*Primary Examiner* — Jennifer E Simmons
(74) *Attorney, Agent, or Firm* — Harness, Dickey & Pierce, P.L.C.

(57) ABSTRACT

A sheet binding unit includes a first sheet binder having first and second dentate uneven sheet binding elements to conduct a first sheet binding process by engaging each other by a prescribed meshing depth while sandwiching the sheet bundle therebetween to form a dentate unevenness on the sheet bundle at a first sheet binding portion of the sheet bundle, and a second sheet binder having third and fourth dentate uneven sheet binding elements to conduct a second sheet binding process by engaging each other by a greater meshing depth than that made by first and second dentate uneven sheet binding elements of the first sheet binder while sandwiching the sheet bundle therebetween to form a dentate unevenness on the sheet bundle at a second sheet binding portion different from the first sheet binding portion of the sheet bundle.

22 Claims, 6 Drawing Sheets

(51) Int. Cl.
*B42C 19/08* (2006.01)
*B65H 31/38* (2006.01)

(52) U.S. Cl.
CPC ..... *B65H 2301/5161* (2013.01); *B65H 2403/514* (2013.01); *B65H 2408/121* (2013.01); *B65H 2553/40* (2013.01); *B65H 2801/27* (2013.01)

(56) References Cited

U.S. PATENT DOCUMENTS

| | | | | |
|---|---|---|---|---|
| 2013/0270762 | A1* | 10/2013 | Saito ..... | B65H 39/00 270/58.08 |
| 2013/0300050 | A1 | 11/2013 | Suzuki et al. | |
| 2014/0138896 | A1 | 5/2014 | Yoshida et al. | |
| 2014/0219747 | A1 | 8/2014 | Takahashi et al. | |
| 2015/0003938 | A1 | 1/2015 | Morinaga et al. | |
| 2015/0076759 | A1 | 3/2015 | Kosuge et al. | |
| 2015/0091246 | A1 | 4/2015 | Yoshida et al. | |
| 2015/0093214 | A1 | 4/2015 | Takahashi et al. | |
| 2016/0107409 | A1* | 4/2016 | Kubo ..... | B31F 1/07 412/33 |

FOREIGN PATENT DOCUMENTS

| | | |
|---|---|---|
| JP | 2011-011913 | 1/2011 |
| JP | 2015-171935 | 10/2015 |

* cited by examiner

SHEET BINDING SYSTEM, IMAGE FORMING APPARATUS WITH SHEET BINDING SYSTEM, AND METHOD OF BINDING SHEET BUNDLE

CROSS-REFERENCE TO RELATED APPLICATION

This patent application is based on and claims priority pursuant to 35 U.S.C. 119(a) to Japanese Patent Application No. 2016-018521 filed on Feb. 3, 2016 in the Japan Patent Office, the entire disclosure of which is hereby incorporated by reference herein.

BACKGROUND

Technical Field

Embodiments of the present disclosure relate to a sheet binding system that binds a sheet bundle, an image forming apparatus, such as a copier, a printer, a facsimile, or a multi-function device (MFD) having multiple functions of these devices, etc., with the sheet binding system, and a method of binding a sheet bundle.

Related Art

A sheet binding system is sometimes employed in an image forming apparatus, such as a copier, a printer, a facsimile, or a multi-function device (MFD) having multiple functions of these devices, etc. A known sheet binding system conducts a sheet binding process without using a metal needle. That is, the sheet binding system forms an uneven portion on a sheet bundle composed of multiple sheets in a thickness direction of the sheet bundle by engaging a pair of dentate uneven portions each other while putting the sheet bundle therebetween during a metal needleless binding process. For this reason, the sheet binding system is known as an environmentally friendly device.

SUMMARY

One aspect of the present disclosure provides a novel sheet binding system that includes a sheet stacking section to stack multiple sheets and generate a sheet bundle, a sheet binding unit to apply a sheet binding process to the sheet bundle stacked on the sheet stacking section at at least one sheet binding portion of the sheet bundle, and a unit shifting device to shift and stop the sheet binding unit from a retracted position to the sheet binding portion of the sheet bundle. The sheet binding unit includes a first sheet binder having first and second dentate uneven sheet binding elements to conduct a first sheet binding process by engaging each other by a prescribed meshing depth while sandwiching the sheet bundle therebetween to form a dentate unevenness on the sheet bundle in a thickness direction of the sheet bundle at a first sheet binding portion of the sheet bundle. A second sheet binder having third and fourth dentate uneven sheet binding elements also included in the sheet binding unit to conduct a second sheet binding process by engaging each other by a greater meshing depth than that made by first and second dentate uneven sheet binding elements of the first sheet binder while sandwiching the sheet bundle therebetween to form a dentate unevenness on the sheet bundle in the thickness direction of the sheet bundle at a second sheet binding portion different from the first sheet binding portion of the sheet bundle.

Another aspect of the present disclosure provides a novel image forming apparatus that includes a housing to house at least one toner image forming device, the above-described sheet binding system, and a sheet ejector to eject a sheet bearing the toner image thereon into the sheet binding system.

Yet another aspect of the present disclosure provides a novel method of binding a sheet bundle. The method includes the steps of stacking multiple sheets on a sheet stacking section to generate a sheet bundle, shifting and stopping a first set of a first dentate uneven sheet binding element and a second dentate uneven sheet binding element and a second set of a third dentate uneven sheet binding element and a fourth dentate uneven sheet binding element from a retracted position to sheet binding portions of the sheet bundle, respectively, and engaging the first set of a first dentate uneven sheet binding element 93*a* and a second dentate uneven sheet binding element each other by a prescribed meshing depth while sandwiching the sheet bundle between the first dentate uneven sheet binding element and the second dentate uneven sheet binding element. The method further includes the steps of forming a dentate unevenness on the sheet bundle in a thickness direction of the sheet bundle at the first sheet binding portion of the sheet bundle, engaging the second set of the third dentate uneven sheet binding element and the fourth dentate uneven sheet binding element 94*b* each other by a different meshing depth from the prescribed meshing depth while sandwiching the sheet bundle between the third dentate uneven sheet binding element and the fourth dentate uneven sheet binding element, and forming a dentate unevenness on the sheet bundle in a thickness direction of the sheet bundle at the second sheet binding portion deviated from the first sheet binding portion of the sheet bundle.

BRIEF DESCRIPTION OF THE DRAWINGS

A more complete appreciation of the present disclosure and many of the attendant advantages of the present disclosure will be more readily obtained as substantially the same becomes better understood by reference to the following detailed description when considered in connection with the accompanying drawings, wherein:

FIG. 5A is an enlarged view schematically illustrating an exemplary first sheet binder of the second sheet binding unit according to one embodiment of the present disclosure;

FIG. 5B is an enlarged view schematically illustrating an exemplary second sheet binder of the second sheet binding unit according to one embodiment of the present disclosure;

DETAILED DESCRIPTION

In a known sheet binding system, a sheet binding process is conducted by rotating a pair of rotators having dentate uneven portions meshing with each other, respectively, while putting a sheet bundle conveyed in a given direction therebetween. In yet another known sheet binding system, rather than conveying a sheet bundle and conducting the sheet binding process in parallel, only after stacking the sheet bundle on a stacking section and moving a sheet binding system having a pair of dentate uneven portions to a sheet binding section, the sheet binding process is started by engaging the pair of uneven portions each other while putting the sheet bundle therebetween. In yet another known sheet binding system that employs a revolver binding technology, to apply a sheet binding process to a sheet bundle with optimal binding force in accordance with a thickness and the number of sheets, multiple binders having different binding powers from each other (a pair of binders) are mounted on a supporting plate and are selectively used.

However, in the above-described first and second known sheet binding systems, due to resistance caused during conveyance of the sheet bundle, the sheet bundle skews, and accordingly the sheet binding process is applied to the skewing sheet bundle. By contrast, the above-described third known sheet binding system is expected to resolve a problem in that the sheet binding process is applied to the skewing sheet bundle. However, since only after detecting a thickness and the number of sheets of the sheet bundle, a supporting plate that accommodates multiple binding units (e.g., a pair of binding units) rotates and brings an optimum binding unit out of the multiple binding units to a position opposed to a sheet binding position of the sheet bundle, the sheet binding process takes a certain time while complicating a configuration and operation of the sheet binding system.

Figure 1:
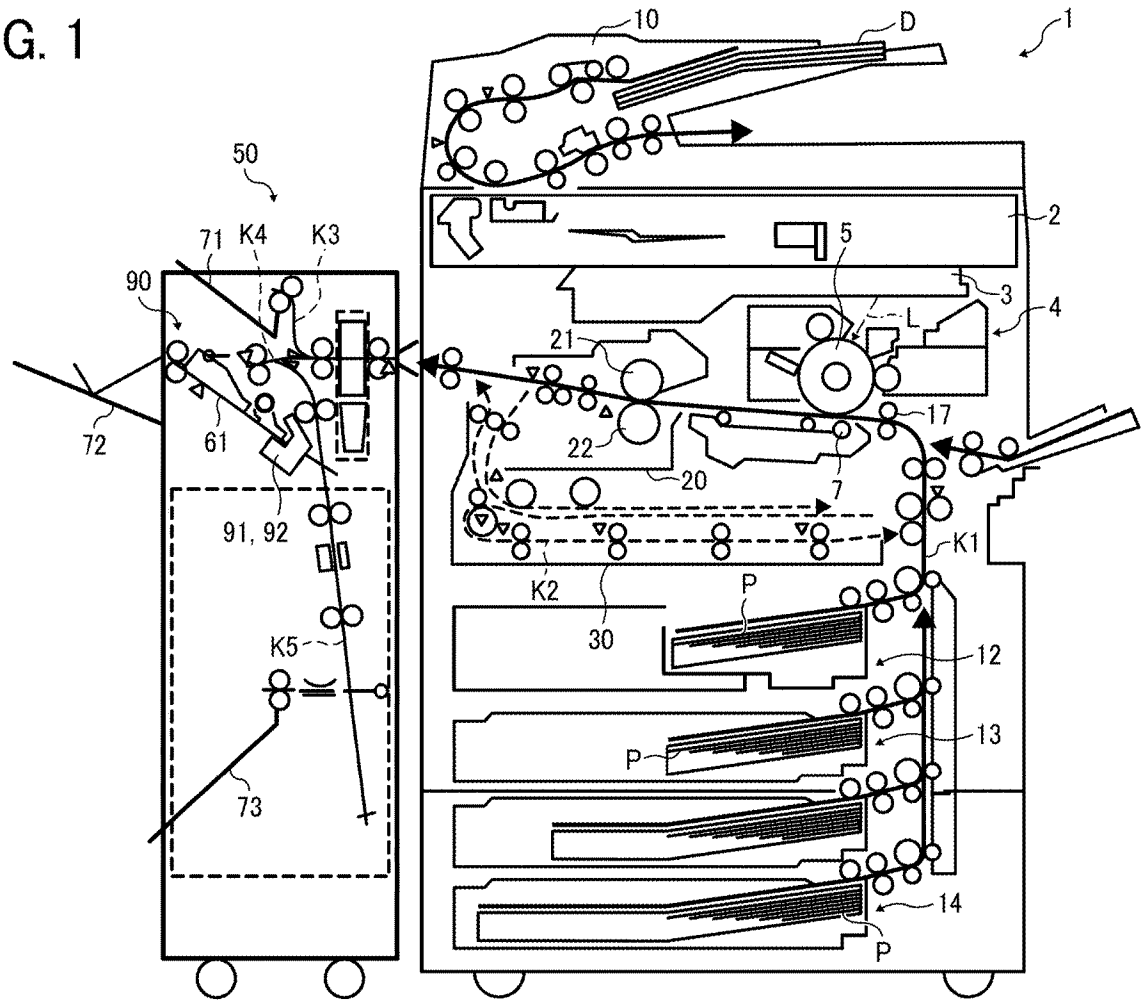
FIG. 1 is a diagram illustrating the entire configuration of an exemplary image forming apparatus according to one embodiment of the present disclosure.

Referring now to the drawings, wherein like reference numerals designate identical or corresponding member throughout the several views of the drawings, and in particular to FIG. 1, the entire configuration and operation of an exemplary image forming apparatus 1 is initially described.

As shown in FIG. 1, an image forming apparatus 1 illustrated as a copier includes an original document reading unit 2, an exposing unit 3, and an image forming unit 4. The image forming apparatus 1 also includes a transfer unit 7, an original document conveying unit 10, and a pair of registration rollers 17. The image forming apparatus 1 further includes a fixing unit 20, a fixing roller 21, and a pressing roller 22. Also included in the image forming apparatus 1 are a duplex copy conveying unit 30, a post-processing machine 50, and a sheet stacking section 61. Further included in the image forming apparatus 1 are multiple trays 71 to 73, a sheet binding system 90, and multiple binding units 91 and 92 as well. An original document reading unit 2 is included in the image forming apparatus 1 to optically read image information of an original document D. An exposing unit 3 is included in the image forming apparatus 1 to irradiate a photoconductive drum 5 with exposing light L based on the image information read by the original document reading unit 2. An image forming unit 4 is also included in the image forming apparatus 1 to form a toner image (e.g., a monochrome or full-color toner image) on a photoconductive drum 5. A transfer unit (i.e., an image forming unit) 7 is also included in the image forming apparatus 1 to transfer the toner image formed on the photoconductive drum 5 onto a sheet P (or a sheet P).

An original document conveying unit 10 is included in the image forming apparatus 1 to convey the original document D set to an original document setting table to the original document reading unit 2. Multiple sheet cassettes 12 to 14 are also included in the image forming apparatus 1 to accommodate sheet bundles of multiple transfer sheets P, respectively. A pair of registration rollers (i.e., a pair of timing rollers) 17 is provided to timely convey the sheet P toward a toner image transfer station 7. A fixing unit 20 is further included in the image forming apparatus 1 to fix an unfixed toner image borne on the sheet P onto the sheet P. A fixing roller 21 is disposed in the fixing unit 20. A pressing roller 22 is also disposed in the fixing unit 20 as well. A duplex copy conveying unit 30 is further included in the image forming apparatus 1 to turn the sheet P upside down after the toner image is formed and transfer onto a front side thereof and to convey the sheet P toward the image forming unit. A post-processing machine 50 is provided downstream of the image forming apparatus 1 to apply a post process to the sheet P ejected from a body of the image forming apparatus 1 and delivered thereinto. A sheet stacking section (i.e., an inner tray) 61 is installed in the post-processing machine 50. Multiple trays (i.e., sheet ejection trays) 71 to 73 are also included in the post-processing machine 50 to stack either the sheet P or the sheet bundle PT discharged after the post process is completed. A sheet binding system 90 is installed in the post-processing machine 50 as well. Multiple binding units 91 and 92 are included in the sheet binding system. The post-processing machine 50 is detachably attached to the body of the image forming apparatus 1.

Now, a typical toner image forming process conducted in the body of the image forming apparatus 1 is described with reference to FIG. 1. First, the original document D is delivered from the original document setting table by an original document conveying roller disposed in the original document conveying unit 10 in a direction as shown by an arrow in the drawing and passes through above the original document reading unit 2. At this moment, in the original document reading unit 2, image information of the original document D passing through above the original document reading unit 2 is optically read. Subsequently, optical image information read by the original document reading unit 2 is converted into an electrical signal, and is thereafter sent to the exposing unit (i.e., a writing unit) 3. Then, the exposing unit 3 irradiates the photoconductive drum 5 provided in the image forming unit 4 with exposing light L, such as a laser beam, etc., based on the image information of the electrical signal.

At the same time, in the image forming unit 4, since the photoconductive drum 5 rotates clockwise in the drawing, a toner image (e.g., a monochrome toner image) is formed on the photoconductive drum 5 when a toner image forming process (i.e., a charging process, an exposing process, a developing process) is applied thereto corresponding to the image information. After that, the toner image formed on the photoconductive drum 5 is transferred on to the sheet P conveyed by a pair of registration rollers 17 in the toner image transfer station 7 acting as a toner image forming section.

Here, the sheet P to be conveyed to the toner image transfer station 7 (i.e., the image forming section) is handled as described herein below. First of all, among these multiple sheet cassettes 12, 13, and 14 provided in the body of the image forming apparatus 1, one of these multiple sheet cassettes 12, 13, and 14 is chosen either automatically or manually. In the present example, the topmost sheet cassette 12 is chosen. Then, the topmost sheet among the multiple sheets P stored in the sheet cassette 12 is conveyed toward a sheet conveyance path K1, in which multiple sheet conveying rollers are disposed.

After that, the sheet P reaches the pair of registration rollers 17 after passing through the sheet conveyance path K1. Then, the sheet P positioned at the pair of registration rollers 17 is timed and conveyed toward the toner image transfer station 7 (i.e., a toner image forming section) to synchronize with the toner image formed and borne on the photoconductive drum 5.

After completing the toner image transfer process and passing through the toner image transfer station 7, the sheet P reaches a fixing unit 20 after passing through the sheet conveyance path K. The sheet P now reaching the fixing unit 20 is fed into a gap between a fixing roller 21 and a pressing roller 22. Then, the toner image borne on the sheet P is fused by heat provided from the fixing roller 21 and pressure provided from both of the fixing roller 21 and the pressing roller 22. The sheet P with the toner image now having been fixed exits from the body of the image forming apparatus 1 after being launched from the gap between the fixing roller 21 and the pressing roller 22 (i.e., a fixing nip).

When a duplex printing mode is chosen as an option to form toner images on both sides (i.e., on the front side and back side) of the sheet P, respectively, the sheet P completing a toner image fixing process on the front side thereof is not ejected as is but is guided by a duplex printing sheet conveyance path K2 as different from when a single-sided print mode, in which the sheet P exits as is, is chosen. Specifically, a sheet conveying direction is reversed in a duplex printing sheet conveying unit 30 and is conveyed once again toward the toner image transfer station 7 (i.e., the image forming section). Then, a similar toner image forming process to the toner image forming process as described earlier is conducted in the toner image transfer station 7 thereby forming another toner image on the backside surface of the sheet P. The sheet P is then discharged from the body of the image forming apparatus 1 after receiving the fixing process in the fixing unit 20 and passing through a sheet conveyance path.

Figure 2:
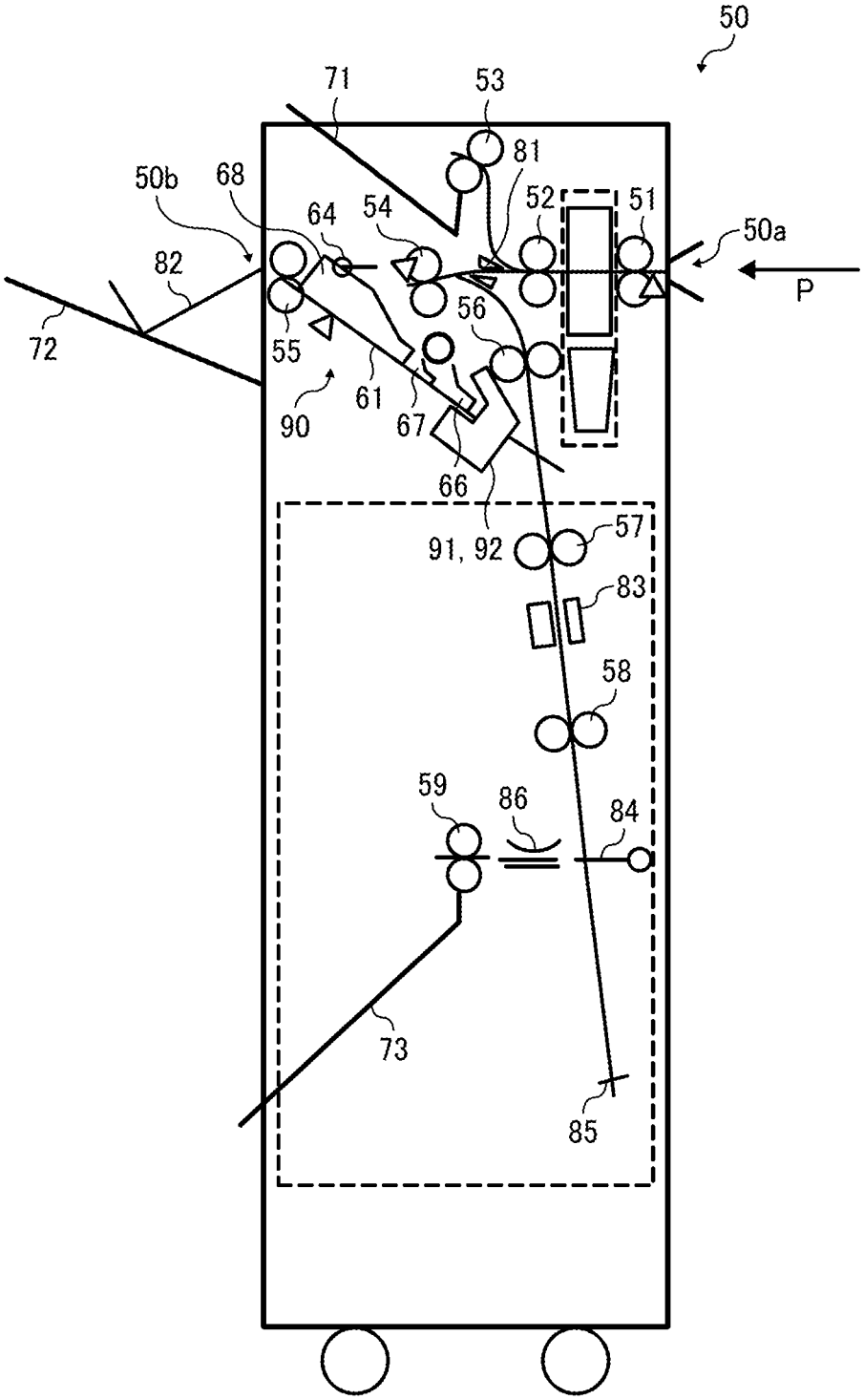
FIG. 2 is a diagram schematically illustrating a configuration of an exemplary post-processing machine according to one embodiment of the present disclosure.

Further, in this embodiment of the present disclosure, as shown in the drawings, a post-processing machine 50 is attached to the image forming apparatus 1. Hence, the sheet P is discharged from the body of the image forming apparatus 1 and enters the post-processing machine 50. The sheet P is then post-processed by the post-processing machine 50 therein. Also as shown in FIG. 1, the post-processing machine 50 of this embodiment of the present disclosure is enabled to convey the sheet P conveyed from the body of the image forming apparatus 1 to any one of three sheet conveyance paths K3 to K5 to be able to apply a different post-processing process to the sheet P. That is, in a first sheet conveyance path K3, the sheet P conveyed from the body of the image forming apparatus 1 exits as is onto the sheet ejection tray 71 without receiving any of the post processes. In the second sheet conveyance path K4, a sheet P conveyed from the body of the image forming apparatus 1 is stacked on the stacking section 61 (i.e., the inner tray) and receives a sheet binding process at a trailing end of the sheet P from either of two sheet binding units 91 and 92 (i.e., sheet binding functions) provided in a sheet binding system 90 acting as a first sheet binding system. Then, the multiple sheets P completes the post process and now a sheet bundle PT is ejected by a pair of sheet ejecting rollers 55 onto an external tray (i.e., a second sheet ejection tray) 72 from a sheet exit 50*b*. In the third sheet conveyance path K5, after a sheet P conveyed from the body of the image forming apparatus 1 is temporarily conveyed to the second sheet conveyance path K4 and switch backed therein, the sheet P receives a sheet binding process at a center of the sheet P from a sheet binding unit (i.e., a second sheet binding system) 83 and/or a folding process from a sheet folding blade 84 or the like. The sheet P is after that ejected onto a third sheet ejection tray 73 (as shown in FIG. 2). The above-described three sheet conveyance paths K3 to K5 is selected by swinging a bifurcating claw 81 in a prescribed direction as needed.

Specifically, as shown in FIG. 2, a first pair of sheet conveying rollers 51 and a sheet detector are installed near a sheet conveyance entrance 50*a* of the post-processing machine 50. Hence, the sheet P is detected by the sheet detector and is further conveyed into the post-processing machine 50 by the first pair of sheet conveying rollers 51 and a second pair of sheet conveying rollers 52. Then, the bifurcating claw 81 is controlled to swing in a prescribed direction to lead the sheet P into a desired one of the sheet conveyance paths K3 to K5 based on a post-processing mode previously chosen by a user (i.e., an operator).

Hence, when a mode without conducting the post process is chosen, the sheet P conveyed into the first sheet conveyance path K3 is discharged onto the first sheet ejection tray 71 by a third pair of sheet conveying rollers 53. When a sort mode is chosen, the sheet P conveyed onto the second sheet conveyance path K4 is further conveyed while being shifted per sheet P by a given amount in a widthwise direction of the sheet P (i.e., perpendicular to a plane of the drawing of FIG. 2) by a pair of sheet conveying rollers 54 enabled to shift in the widthwise direction. The sheet P is then conveyed by a pair of sheet ejecting rollers (i.e., a fifth pair of sheet conveying rollers) 55 and is successively stacked on an external tray (i.e., a second sheet ejection tray) 72.

The external tray 72 is now more specifically described with reference to FIG. 2. As shown there, above the external tray 72, a filler 82 is disposed to freely swing around an upper end supporting axis thereof as a pivot. The external tray 72 is vertically movable and is moved by a tray moving mechanism. Hence, when the sheet P is successively stacked on the external tray 72, a central portion of the sheet P in the sheet conveying direction contacts the filler 82 and such contact is detected by a sensor placed near the supporting shaft of the filler 82. Accordingly, a height of the sheet P stacked on the external tray 72 is recognized. Then, in proportion to a degree of increase or decrease in number of sheets P stacked on the external tray 72, a vertical position of the external tray 72 is adjusted (i.e., the external tray 72 goes up and down). Further, when a vertical position of the external tray 72 reaches a lower limit, it is regarded that the number of the sheet P stacked on the external tray 72 reaches the maximum level of stacking (i.e., the external tray 72 becomes full), the post-processing machine 50 sends a stop signal to the image forming apparatus 1 to stop formation of a toner image.

By contrast, when a sheet binding mode (e.g., a staple mode) is chosen, the sheet P conveyed onto the second sheet conveyance path K4 is further conveyed without being shifted by the fourth pair of sheet conveying rollers 54 and is successively stacked on the sheet stacking section 61 (i.e., the inner tray). Then, every when the sheets P (i.e., a sheet bundle PT) are placed on a stacking surface of the sheet stacking section 61, a sheet slapping roller 64 and an auxiliary sheet conveying roller 65 (see FIG. 3) each placed above the stacking surface of the sheet stacking section 61 move to contact positions contacting the uppermost sheet P from retracted positions. Hence, since the sheet slapping roller 64 and the auxiliary sheet conveying roller 65 are driven and rotated counter clockwise in FIG. 2, the sheet P is conveyed (i.e., shifted) toward a fence (i.e., an end fence) 66. With this, ends (i.e., trailing ends in a conveying direction) of several sheets P (i.e., a sheet bundle PT) collide with the end fence 66 and are aligned in the sheet conveying direction thereof.

Figure 3:
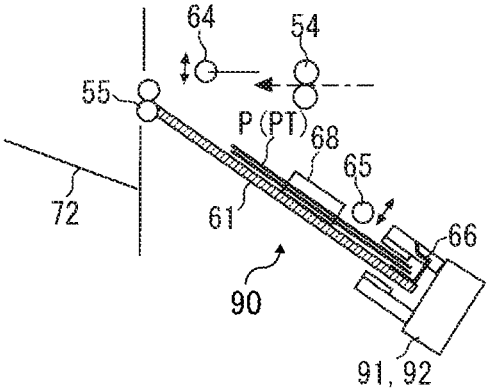
FIG. 3 is a diagram schematically illustrating a configuration of an exemplary binding system according to one embodiment of the present disclosure.

At the same time, as shown in FIGS. 2 to 4, a pair of jogger fences 68 (i.e., side fences) are arranged in the widthwise ends of the sheet stacking section 61 and move (or reciprocate) in the widthwise direction to almost sandwich the sheet P (i.e., the sheet bundle PT) every when the sheet P is mounted (or after a desired number of sheets P has been stacked) on the sheet stacking section 61 to align the multiple sheets P in the widthwise direction. Then, a sheet binding process is applied to the end of the sheet P now aligned both in the sheet conveying direction and the widthwise direction (i.e., the end of the sheet bundle) by the sheet binding system 90. Then, the multiple sheets P, now the sheet bundle PT, completing the sheet binding process are conveyed upward along an inclination of the sheet stacking surface by a discharge claw 67 as the discharge claw 67 moves in a sheet ejecting direction. Then, the multiple sheets P (i.e., the sheet bundle PT) are conveyed and ultimately emitted onto the external tray 72 by the pair of sheet ejecting rollers 55. Here, in the sheet binding system 90 of this embodiment of the present disclosure, a first sheet binding unit 91 to execute a sheet binding process using a metal needle and a second sheet binding unit 92 to execute a sheet binding process without using the metal needle are installed. Hence, one of the sheet binding units 91 and 92 is selectively used to apply a prescribed binding process to the sheet bundle PT as described later more in detail.

Further, when a folding mode is chosen, the sheet P is firstly conveyed to the second sheet conveyance path K4. The sheet P is then switch backed with its trailing end being sandwiched by the pair of fourth sheet conveying rollers 54 when the pair of fourth sheet conveying rollers 54 is reversely rotated and is further conveyed to the third sheet conveyance path K5. Then, the sheet P conveyed to the third conveyance path K5 is further conveyed by pairs of sixth to eighth sheet conveying rollers 56 to 58 to a position at which a central portion of the sheet P is opposed to the second sheet binding system 83 (i.e., a position at which a pair of conveyance guide plates acts as a stacking section). Then, after the desired number of sheets P (i.e., the sheet bundle PT) are stacked at the position, a sheet binding process is applied to a middle portion of the sheet bundle PT by the second sheet binding system 83. Subsequently, these plural sheets P (i.e., the sheet bundle PT) having received the sheet binding process are further conveyed by the pairs of seventh and eighth sheet conveying rollers 57 and 58 to a prescribed position, at which the middle portion of the sheet P (i.e., the sheet bundle PT) is again opposed to a sheet folding blade 84. At that time, a leading end of each of the multiple sheets P (i.e., the sheet bundle PT) bumps against a stopper 85 moved by a stopper moving mechanism in the sheet conveying direction. Then, the multiple sheets P (i.e., the sheet bundle PT) are folded at the center thereof by the sheet folding blade 84 as it moves to a left side in FIG. 2. A folded portion of the sheet bundle PT is then squeezed almost flat and pressed by a pair of sheet folding plates 86 thereby completing a sheet folding process. Then, the multiple sheets P (i.e., the sheet bundle PT) completing the sheet folding process is conveyed by a pair of ninth sheet conveying rollers 59 and is ultimately discharged onto a third sheet ejection tray 73.

Figure 4A:
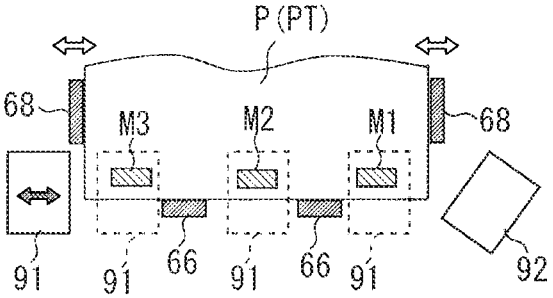
FIGS. 4A and 4B are diagrams collectively illustrating a top view of the sheet binding system of FIG. 3 when schematically taken in a widthwise direction of the sheet binding system.
Figure 4B:
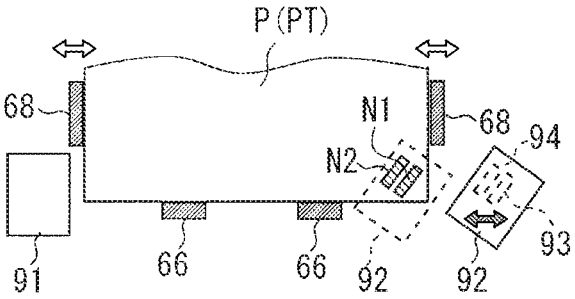
Figure 4C:
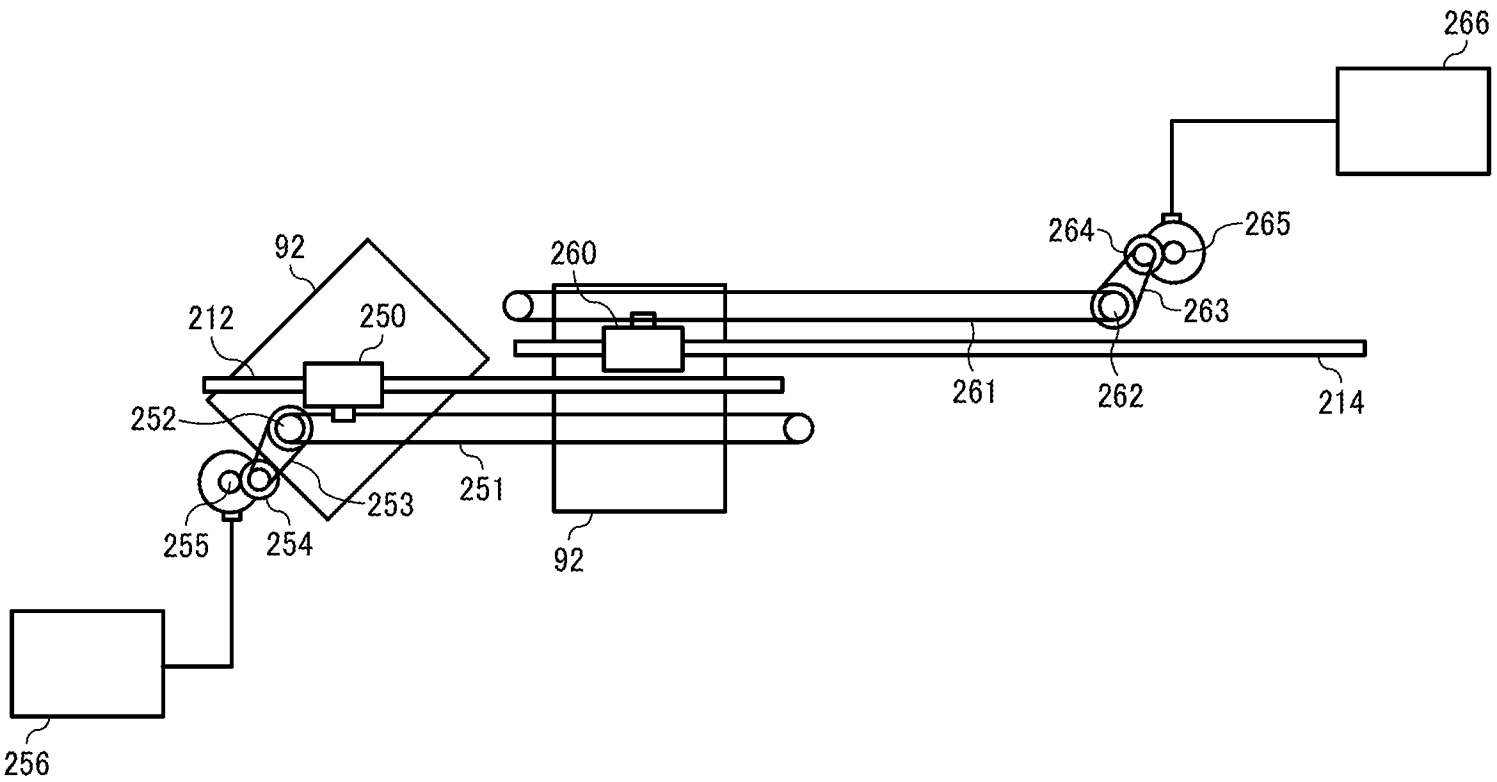
FIG. 4C is a diagram schematically illustrating an exemplary unit shifting mechanism as a unit shifting device that shifts a sheet binding unit included in the sheet binding system of FIG. 3 between a retracted position and a sheet binding portion of a sheet bundle according to one embodiment of the present disclosure.

Now, an exemplary configuration and operation of the sheet binding system 90 of this embodiment of the present disclosure is described more in detail mainly with reference to FIGS. 3 to 4C. As described earlier with reference to FIGS. 1 and 2 or the like, in this embodiment of the present disclosure, there is provided the sheet binding system 90 inside the post-processing machine 50 to apply the sheet binding process to the sheet bundle PT. More specifically, in this sheet binding system 90, the sheet stacking section 61 is installed to stack multiple sheets P as the sheet bundle PT. The pair of jogger fences 68 is also installed in the sheet binding system 90 as a sheet aligner to align the sheet bundle PT stacked on the sheet stacking section 61 in a widthwise direction thereof (i.e., a direction perpendicular to a plane of the drawing of FIGS. 2 and 3 and a left and right direction in FIGS. 4A and 4B as well). The fence (i.e., the end fence) 66 is also installed in the sheet binding system 90 as the sheet aligner to align the sheet bundle PT stacked on the sheet stacking section 61 in the sheet conveying direction thereof (i.e., a direction along a stacking surface of the sheet stacking section 61 as shown in FIGS. 2 and 3 and a vertical direction in FIGS. 4A and 4B as well). The first sheet binding unit 91 is also installed in the sheet binding system 90 to apply a sheet binding process to multiple binding portions M1 to M3 of the sheet bundle PT stacked on the sheet stacking section 61 by using metal needles, respectively. Further, the second sheet binding unit 92 is also installed in the sheet binding system 90 to apply a sheet binding process to multiple binding portions N1 and N2 of the sheet bundle PT stacked on the sheet stacking section 61 without using the metal needle.

Here, the sheet stacking section 61 is configured with its mounting surface tilting upward from one end thereof (i.e., on the right in FIGS. 2 and 3) to the other end (i.e., on the left in FIGS. 2 and 3). Thus, the sheet stacking section 61 acts as a sheet collector to collect multiple sheets to generate the sheet bundle PT. Hence, the sheet binding units 91 and 92 are disposed below the inclined surface of the sheet stacking section 61 and far from the sheet exit 50*b*.

That is, in the sheet binding system 90 in this embodiment of the present disclosure, there are provided two sheet binding units 91 and 92. Specifically, as shown in FIGS. 4A and 4B, when a non-binding process is executed, the first sheet binding unit 91 configured to execute a sheet binding process by using needles (e.g., metal needles) is evacuated to one end in the widthwise direction (i.e., a direction perpendicular to a plane of the drawing of FIG. 3 and a left and right direction in FIGS. 4 and 6). In the opposite side in the widthwise direction, the second sheet binding unit 92 configured to perform a sheet binding process without needles (e.g., metal needles) is also escaped. To guide each of the first and second sheet binding units 91 and 92 in a given direction (i.e., a direction perpendicular to the sheet conveying direction of the sheet P), a unit shifting device is provided in the sheet binding system 90 as shown in FIG. 4C. That is, FIG. 4C is a diagram schematically illustrating an exemplary configuration of a unit shifting device when viewed from a bottom side (i.e., a guide rail side) of the sheet binding system 90. As shown in the drawing, the exemplary unit shifting device shifts the first sheet binding unit 91 and the second sheet binding unit 92, independently. Specifically, as a system to operate the first sheet binding unit 91, the unit shifting device includes a first bearing 260 that secures the first sheet binding unit 91 to a first guide rail 214 and a first drive belt 261 at the same time. The unit shifting device also includes a first drive motor 265 to transmit power of the first drive motor 265 to the first drive belt 261 via first driven pulleys 262 and 264 and a first drive belt 263. The first drive motor 265 is controlled by a first drive controller 266 to shift and stop the first sheet binding unit 91 at one or more prescribed sheet binding positions as shown by broken lines in FIG. 4A, and return (i.e., reciprocate) the first sheet binding unit 91 to an initial position as a first retracted position as shown by a solid line in FIG. 4A. More specifically, the first drive motor 265 is controlled by detecting the first sheet binding unit 91 at the one or more prescribed sheet binding positions with one or more first position detectors, respectively.

Similarly, as a system to operate the second sheet binding unit 92, the unit shifting device includes a second bearing 250 that secures the second sheet binding unit 92 to a second guide rail 212 and a second drive belt 251 at the same time. The unit shifting device also includes a second drive motor 255 to transmit power of the second drive motor 255 to the second drive belt 251 via second driven pulleys 252 and 254 and a second drive belt 253. The second drive motor 255 is controlled by a second drive controller 256 to shift and stop the second sheet binding unit 92 at a prescribed sheet binding position as shown by a broken line in FIG. 4B, and return (i.e., reciprocate) the second sheet binding unit 92 to an initial position as a second retracted position as shown by a solid line in FIG. 4B. More specifically, the second drive motor 255 is controlled by detecting the second sheet binding unit 92 at the prescribed sheet binding position with a second position detector.

Hence, the first sheet binding unit 91 receives driving force from a first drive unit and accordingly shifts from a first reference position located at one end of the sheet bundle PT stacked on the sheet stacking section 61 in a widthwise direction thereof (i.e., a position as shown by a solid line in FIGS. 4A and 4B) to the other end (i.e., on the right side in FIGS. 4A and 4B). The first sheet binding unit 91 then applies binding process (i.e., a metal needle binding process) to the sheet bundle PT at each of the sheet binding portions M1 to M3. More specifically, in this embodiment of the present disclosure, as shown in FIG. 4A, the first sheet binding unit 91 targets the almost entire area of one end (i.e., the trailing end of the sheet bundle PT) in the sheet conveying direction (i.e., in the vertical direction in FIG. 4A) and applies the sheet binding process to three separated sheet binding portions M1 to M3 of the sheet bundle PT aligned in both widthwise and conveying directions thereof by the pair of Jogger fence 68 and the end fence 66, respectively. More specifically in this embodiment of the present disclosure, first of all, among these three sheet binding portions M1 to M3, the first sheet binding unit 91 shifts to the sheet binding portion M3 (a position indicated by a broken line in FIG. 4A) positioned on the leftmost side (i.e., one end in the widthwise direction) from the first reference position (i.e., a reference position on the left of the left side end of the sheet bundle PT in FIG. 4A), and applies the sheet binding process to the sheet binding portion M3. The first sheet binding unit 91 then shifts to the sheet binding portion M2 positioned at a center adjacent to the sheet binding portion M1 on the right side in the widthwise direction (i.e., a position indicated by a broken line in FIG. 4A), and applies the same binding process to the sheet binding portion M2. Finally, the first sheet binding unit 91 shifts to the sheet binding portion M1 positioned at the other end adjacent to the sheet binding portion M2 on the right side in the widthwise direction (i.e., a position also indicated by a broken line in FIG. 4A), and applies the same binding process to the sheet binding portion M1. After that, the first sheet binding unit 91 shifts in the opposite direction and returns to the first reference position. In this embodiment of the present disclosure, although the first sheet binding unit 91 applies the sheet binding process to three sheet binding portions M1 to M3 almost evenly separated in the widthwise direction, the number and location of these binding portions are not limited thereto, and the sheet binding process can be conducted in various manners. Here, the first sheet binding unit 91 can employ a known system to conduct the sheet binding process using the metal needle.

By contrast, the second sheet binding unit 92 receives driving force from a second drive unit (i.e., a unit shifting device) and shifts from a second reference position located at the other end of the sheet bundle PT stacked on the sheet stacking section 61 in a widthwise direction thereof (i.e., a position as shown by a solid line in FIGS. 4A and 4B) to the one end (i.e., on the left side in FIGS. 4A and 4B). At that time, the second sheet binding unit 92 applies a sheet binding process (i.e., a needleless binding process) to the sheet bundle PT at each of binding portions N1 and N2. As described heretofore and with additionally reference to FIG. 5, to conduct the sheet binding process, the second sheet binding unit 92 forms an unevenness on the sheet bundle PT in its thickness direction by engaging a pair of dentate uneven portions 93*a*1 and 93*b*1 (or a pair of dentate uneven portions 94*a*1 and 94*b*1) each other while sandwiching the sheet bundle PT therebetween and thereby engaging the sheets P each other. As shown in the drawing, in this embodiment of the present disclosure, the second sheet binding unit 92 includes two binders 93 and 94 (each having a pair of uneven portions) to apply binding processes to the sheet bundle PT at two binding portions N1 and N2 thereof, respectively, as described later more in detail.

As described heretofore and with additional reference to FIG. 4B, in this embodiment of the present disclosure, to each of the sheet binding portions N1 and N2 located in a corner of one end of in the sheet bundle PT in a conveying direction (i.e., the vertical direction in FIG. 4B), positions in widthwise and sheet conveying directions of which are determined by the Jogger fence 68 and the end fence 66, the sheet binding process is applied. Toward these corner binding portions N1 and N2, the second sheet binding unit 92 shifts from the second reference position (i.e., the reference position located on the right of the right end of the sheet bundle PT of FIGS. 4A and 4B) to prescribed positions (i.e., the sheet binding portions N1 and N2 as shown by broken lines in FIG. 4B) and applies the sheet binding process to each of the sheet binding portions N1 and N2. After completing each of the sheet binding processes to the sheet binding portions N1 and N2, the second sheet binding unit 92 shifts in the opposite direction and returns to the second reference position.

Since the sheet binding system 90 is configured in this way, either of two sheet binding units 91 and 92 is chosen by the user (i.e., the operator) and a prescribed binding process is conducted based on a choice of him or her. Specifically, the user handles a control panel mounted on an exterior of the body of the image forming apparatus 1 (or that of the post-processing machine 50), for example, and chooses any one of the sheet binding processes (i.e., with the metal needle and without the metal needles). Hence, when the sheet binding process (with the metal needle) is chosen, the first sheet binding unit 91 conducts the sheet binding process. By contrast, when the second sheet binding process (without the metal needle) is chosen, the second sheet binding unit 92 conducts the other binding process. Hence, when the sheet binding process is conducted by one of the sheet binding units 91 and 92 chosen, the other one of the sheet binding units 91 and 92 not chosen is evacuated to the reference position thereof. In this way, by establishing the multiple binding units 91 and 92, a range of choice of the sheet binding process can be expanded for the user.

Now, an exemplary configuration and operation of the second sheet binding unit 92 constituting a distinctive feature of the sheet binding system 90 of the post-processing machine 50 is described more in detailed with reference to FIGS. 4 to 7 according to one embodiment of the present disclosure. As described earlier with reference to FIGS. 4A and 4B, the second sheet binding unit 92 conducts the sheet binding process to the sheet bundle PT stacked on the sheet stacking section 61 when it is shifted to and stopped at the sheet binding portions N1 and N2 by the unit shifting device. That is, as shown in FIGS. 4A to 6, in this embodiment of the present disclosure, the second sheet binding unit 92 includes multiple binders (i.e., the first sheet binder 93 and the second sheet binder 94) each including (a pair of sheet binding elements engaging each other) having a different meshing depth from the other.

Figure 5A:
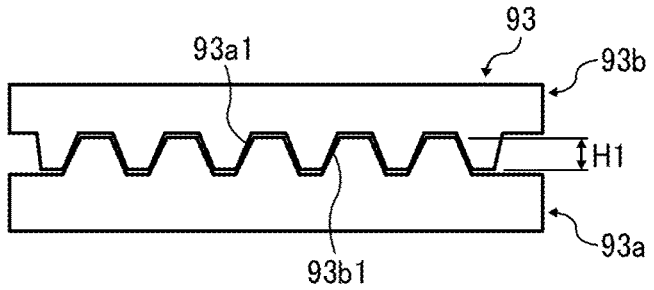
FIGS. 5A and 5B are diagrams collectively illustrating an exemplary second sheet binding unit according to one embodiment of the present disclosure.

Specifically, as shown in FIG. 5A, the first sheet binder 93 includes a pair of dentate uneven portions 93*a*1 and 93*b*1 that engage each other while almost sandwiching the sheet bundle PT therebetween to form dentate unevenness in the first sheet binding portion N1 (as shown in FIG. 4B) of the sheet bundle PT in its thickness direction thereby completing binding process. More specifically, as shown there, the first sheet binder 93 includes a pair of first and second sheet binding elements 93*a* and 93*b* almost vertically disposed. The first sheet binding element 93*a* includes the dentate uneven portion 93*a*1 at its upper surface. The second sheet binding element 93*b* also includes the dentate uneven portion 93*b*1 at its lower surface to mesh with the dentate uneven portion 93*a*1 of the first sheet binding element 93*a*. The second sheet binding element 93*b* is configured to be movable in relation to the first sheet binding element 93*a* to almost sandwich the sheet bundle PT together with the first sheet binding element 93*a* therebetween. Hence, while the sheet bundle PT is sandwiched by the first and second sheet binding elements 93*a* and 93*b*, the sheet binding process is applied to the first sheet binding portion N1.

Figure 5B:
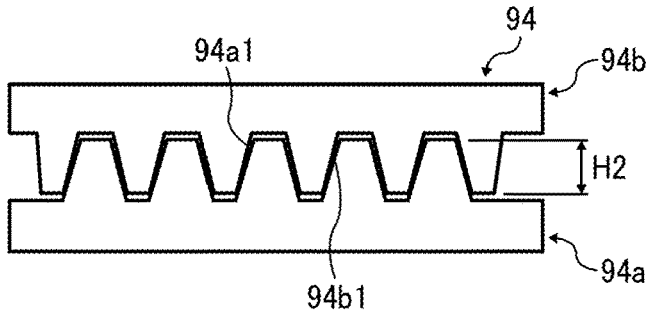

Further, as shown in FIG. 5B, the second sheet binder 94 also includes a pair of dentate uneven portions 94*a*1 and 94*b*1 that engage each other while almost sandwiching the sheet bundle PT therebetween to form dentate unevenness on the second sheet binding portion N2 (as shown in FIG. 4B) of the sheet bundle PT in its thickness direction thereby completing binding process. More specifically, as shown there, the second sheet binder 94 includes a pair of first and second sheet binding elements 94*a* and 94*b* almost vertically disposed. The first sheet binding element 94*a* includes a dentate uneven portion 94*a*1 at its upper surface. The second sheet binding element 94*b* also includes a dentate uneven portion 94*b*1 at its lower surface to mesh with the dentate uneven portion 94*a*1 of the first sheet binding element 94*a*. The second sheet binding element 94*b* is configured to be movable in relation to the first sheet binding element 94*a* to almost sandwich the sheet bundle PT with the first sheet binding element 94*a* therebetween. Hence, while the sheet bundle PT is sandwiched by the first and second sheet binding elements 94*a* and 94*b*, the sheet binding process is applied to the second sheet binding portion N2.

Further, as shown in FIGS. 5A and 5B, the meshing depth H2 of the uneven portions 94*a*1 and 94*b*1 of the second sheet binder 94 is greater than the meshing depth H1 of the uneven portions 93*a*1 and 93*b*1 of the first sheet binder 93 (i.e., H2>H1).

Further, as shown there, a position of the first sheet binding portion N1 and that of the second sheet binding portion N2 each formed by the second sheet binding unit 92 on the sheet bundle PT are different from each other. Specifically, the second sheet binding portion N2 is displaced from the first sheet binding portion N1 on the sheet bundle PT. These binding portions N1 and N2 receive the sheet binding process without the metal needle.

More specifically, as shown in FIG. 4B, the first and second sheet binding portions N1 and N2 are arranged side by side at a prescribed interval in a corner of the sheet bundle PT near and far from a square corner, at which two sides forming the corner intersect with each other, respectively. In this embodiment of the present disclosure, on the closest side to the square corner of the sheet bundle PT, the first sheet binding portion N1 is formed. By contrast, the second sheet binding portion N2 is formed far from the square corner of the sheet bundle PT at a prescribed interval from the first sheet binding portion N1. That is, the first sheet binding portion N1 and the second sheet binding portion N2 are separated from each other by a prescribed length so that binding forces applied to these sheet binding portions N1 and N2 do not affect to each other. At the same time, however, the first sheet binding portion N1 and the second sheet binding portion N2 are formed close to each other as long as these sheet binding portion N1 and N2 do not spread from a margin of the sheet bundle PT. Hence, as described earlier with reference to FIG. 4B, when the sheet binding process is applied to these two sheet binding portions N1 and N2, the second sheet binding unit 92 shifts from the second reference position (i.e., the reference position located on the right of the right end of the sheet bundle PT in FIG. 4B) to the prescribed binding positions (i.e., the sheet binding portions N1 and N2 shown by broken lines in FIG. 4B) located on the left than the second reference position and stops at the prescribed binding positions. The second sheet binding unit 92 then conducts series of binding processes while stopping at the respective prescribed binding positions.

In this way, the sheet binding system 90 (i.e., the second sheet binding unit 92) of this embodiment of the present disclosure does not apply the sheet binding process to the sheet bundle PT during conveyance of the sheet bundle PT. That is, the second sheet binding unit 92 of this embodiment of the present disclosure shifts to the sheet binding positions (i.e., the sheet binding portions N1 and N2) of the sheet bundle PT stacked and stopping at the sheet stacking section 61. More specifically, each of the sheet binders 93 and 94 conducts the sheet binding process by engaging the dentate uneven portions thereof each other while sandwiching the sheet bundle PT therebetween. For this reason, a problem in that the sheet binding process is applied to the sheet bundle PT skewing due to resistance caused during conveyance of the sheet bundle PT can be resolved. Especially, in this embodiment of the present disclosure, as described earlier, since the sheet bundle PT stacked on the sheet stacking section 61 is aligned by the end fence of 66 and the pair of jogger fences 68 collectively acting as the sheet aligner before the second sheet binding unit 92 (or the first sheet binding unit 91) applies the sheet binding process to the sheet bundle PT, the problem in that the sheet binding process is applied to the sheet bundle PT in a skew state can be more definitely resolved.

Further, in this embodiment of the present disclosure, to conduct series of binding processes with the second sheet binding unit 92, that is, to apply the sheet binding processes to the different sheet binding portions N1 and N2 in the sheet bundle PT without using the metal needles, since the sheet binders 93 and 94 (i.e., multiple devices) are utilized and have different meshing depths H1 and H2 from each other, respectively, a configuration and control of the sheet binding system can be simplified at the same time while suppressing waste of time during the sheet binding process. In addition, the sheet binding process can be precisely applied to the sheet bundle PT by using preferable binding forces in accordance with a thickness and the number of sheets of the sheet bundle PT even when the thickness or the number of sheets varies. That is, when the sheet bundle PT is constituted by either thick sheets P or a large number of sheets P and accordingly becomes thick, due to the small meshing depth H1, binding force generated by the first sheet binder 93 in the first sheet binding portion N1 becomes weak (i.e., insufficient to preferably bind the sheet bundle PT), thereby possibly causing a sheet binding error. However, since binding force generated by the second sheet binder 94 in the second sheet binding portion N2 is stronger and is preferably maintained due to the greater meshing depth H1, prescribed preferable binding force (i.e., binding quality) can be ensured by the second sheet binding unit 92 as a whole. Further, when the sheet bundle PT is constituted by either thin sheets P or a small number of sheets P and accordingly becomes thin, due to the great meshing depth H2, binding force generated by the second sheet binder 94 in the second sheet binding portion N2 becomes excessive, thereby generating a risk to tear the sheet P in the sheet bundle PT. However, since binding force generated by the first sheet binder 93 in the first sheet binding portion N1 is preferably maintained due to the small meshing depth H1, prescribed preferable binding force (i.e., binding quality) can be ensured by the second sheet binding unit 92 as a whole.

Here, in the second sheet binding unit 92 of this embodiment of the present disclosure, a time when the first sheet binder 93 applies the sheet binding process to the first sheet binding portion N1 of the sheet bundle PT and thereby generating the maximum pressure in the first sheet binding portion N1 thereof is designed to be not equivalent to a time when the second sheet binder 94 applies the sheet binding process to the second sheet binding portion N2 of the sheet bundle PT and thereby generating the maximum pressure in the second sheet binding portion N2 thereof. That is, as understood from FIGS. 7A and 7B, a time when the first sheet binder 93 applies the sheet binding process to the first sheet binding portion N1 is not equivalent and is deviated from a time when the second sheet binder 94 applies the sheet binding process to the second sheet binding portion N2. The above-described time when the maximum pressure is generated in each of the sheet binding portions N1 and N2 is either a time when a pair of dentate uneven portions starts engaging each other while sandwiching the sheet bundle PT therebetween and forming dentate uneven portions on the sheet bundle PT or a delayed time a little bit later than the time.

Figure 6:
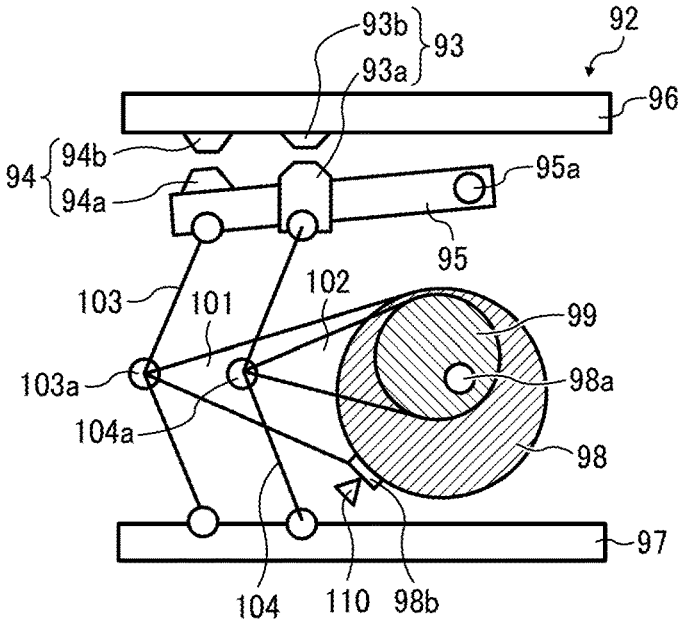
FIG. 6 is a diagram schematically illustrating an exemplary configuration of the second sheet binding unit according to one embodiment of the present disclosure.

That is, as shown in FIG. 6, in the second sheet binding unit 92, an upper plate 96 and a lower plate 97 are secured to a side plate thereby collectively constituting a housing (i.e., a frame) of the second sheet binding unit 92. To the upper plate 96, the second sheet binding element 93*b* of the first sheet binder 93 and the second sheet binding element 94*b* of the second sheet binder 94 are fixed. Similarly, a first sheet binding element 94*a* of the second sheet binder 94 is secured to an arm 95 enabled to swing around a supporting shaft 95*a*. A first sheet binding element 93*a* of the first sheet binder 93 is held by the arm 95 and is enabled to move up and down from and to the arm 95. Also provided in the second sheet binding unit 92 are a first eccentric cam 99 and a second eccentric cam 98 to rotate around a common eccentric shaft 98*a* to provide eccentric rotations in different phases from each other, respectively. In addition, a first connecting rod 102 and a first link 104 are provided in the second sheet binding unit 92. The first connecting rod 102 is connected to a node 104*a* of the first link 104 at its one end and the first eccentric cam 99. The first link 104 is connected to the first sheet binding element 93*a* of the first sheet binder 93 at its one end and the lower plate 97 at its other end as well. Similarly, a second connecting rod 101 and a second link 103 are provided in the second sheet binding unit 92. The second connecting rod 101 is connected to a node 103*a* of the second link 103 at its one end and the second eccentric cam 98 at its other end as well. The second link 103 is connected to the arm 95 at its one end and the lower plate 97 at its other end as well. Further, as shown in FIG. 6, an optical sensor 110 is also provided in the second sheet binding unit 92. That is, in each of the first and second sheet binders 93 and 94, a standby state, in which the first sheet binding elements 93*a* and 94*a* separate from the second sheet binding elements 93*b* and 94*b*, respectively, is recognized by the optical sensor 110. Specifically, the optical sensor 110 optically detects a detection target 98*b* disposed in a prescribed portion of a surface of the second eccentric cam 98. In addition, a driving motor is also provided in the second sheet binding unit 92 to rotate the first and second eccentric cams 99 and 98.

Figure 7A:
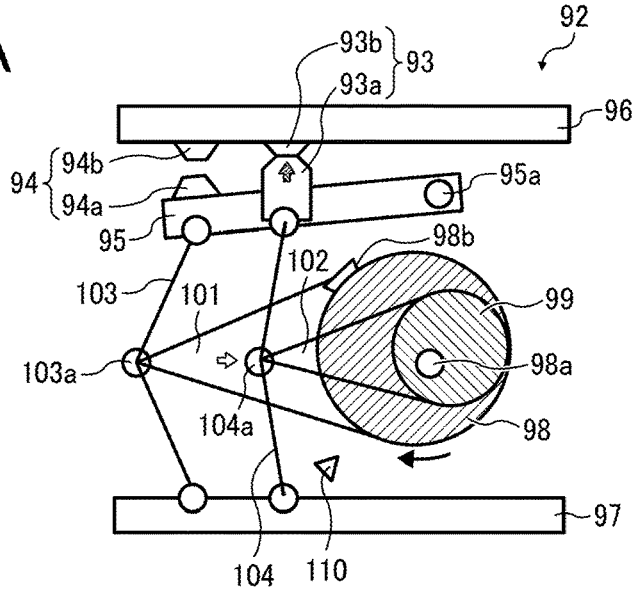
FIGS. 7A and 7B are diagrams schematically and collectively illustrating exemplary operation of the second sheet binding unit according to one embodiment of the present disclosure.
Figure 7B:
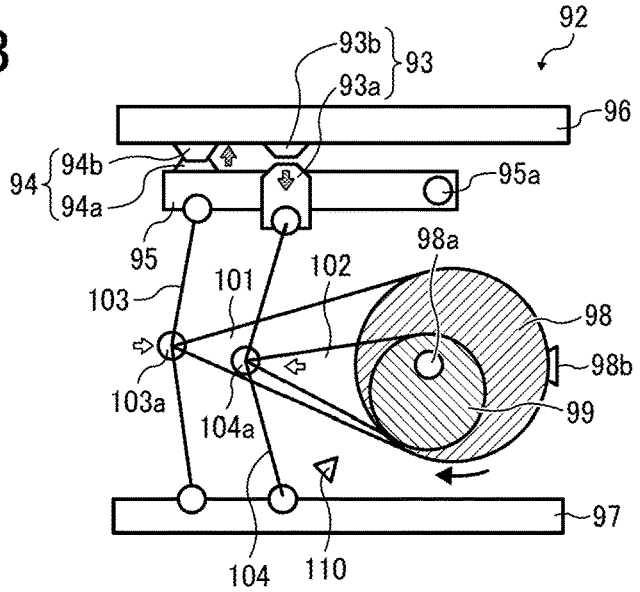

Now, an exemplary binding process conducted by the second sheet binding unit 92 is typically described herein below with further reference to FIGS. 7A and 7B. When the first eccentric cam 99 and the second eccentric cam 98 are rotated clockwise in FIGS. 7A and 7B (i.e., a direction shown by an arrow in the drawings) by the driving motor around a shaft 98*a*, since rotation phases of the first eccentric cam 99 and the second eccentric cam 98 are different from each other, the first sheet binding element 93*a* and the second sheet binding element 93*b* of the first sheet binder 93 initially engage each other from the standby state shown in FIG. 6. At the same time, the first sheet binding element 94*a* and the second sheet binding element 94*b* of the second sheet binder 94 yet separate from each other as shown in FIG. 7A. Hence, the sheet binding process is applied to the first sheet binding portion N1. When the first eccentric cam 99 and the second eccentric cam 98 are further rotated, as shown in FIG. 7B, the first sheet binding element 93*a* and the second sheet binding element 93*b* of the first sheet binder 93 disengage from each other and the first sheet binding element 94*a* and the second sheet binding element 94*b* of the second sheet binder 94 engage each other. Hence, the sheet binding process is applied to the second sheet binding portion N2.

Hence, according to this embodiment of the present disclosure, since a time to apply the sheet binding process to the first sheet binding portion N1 by using the first sheet binder 93 is slightly deviated from a time to apply the sheet binding process to the second sheet binding portion N2 by using the second sheet binder 94, the maximum load on a driving source (e.g., the driving motor) employed in the second sheet binding unit 92 may be reduced more than when the above-described times are substantially the same. With this, the second sheet binding unit 92 can be downsized at low cost as well.

Figure 8:
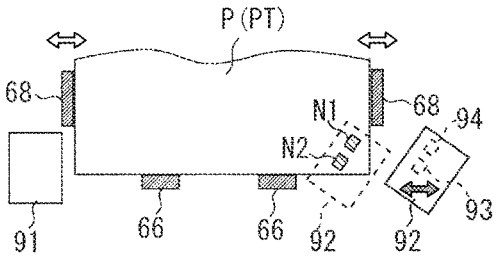
FIG. 8 is a top view schematically illustrating an essential part of an exemplary sheet binding unit when taken in a widthwise direction of the sheet binding unit according to one modification of the present disclosure.

Now, an exemplary modification of the present disclosure is described with reference to FIG. 8. That is, FIG. 8 is a top view schematically illustrating an essential part of a sheet binding system 90 according to the modification of the present disclosure when taken in a widthwise direction thereof. As shown there, FIG. 8 is a view corresponds to the embodiment of the present disclosure shown in FIG. 4B. As shown there, in the modification of the present disclosure, first and second sheet binding portions N1 and N2 are placed side by side at a prescribed interval in a corner of the sheet bundle PT. That is, one of the first and second sheet binding portions N1 and N2 is positioned near one side out of two sides collectively forming a corner of the sheet bundle PT, and the other one of the first and second sheet binding portions N1 and N2 is positioned near another side out of the two sides. Specifically, the second sheet binding portion N2 is formed on the rear end (of the sheet bundle PT) hitting the end fence 66. On the side end (of the sheet bundle PT) hitting one of the pair of jogger fences 68, the first sheet binding portion N1 is diagonally formed parallel to the second sheet binding portion N2 at a prescribed interval. The first sheet binding portion N1 and the second sheet binding portion N2 are separated from each other to the extent that binding forces generated in the first sheet binding portion N1 and the second sheet binding portion N2, respectively, do not mutually impact each other. However, the first sheet binding portion N1 and the second sheet binding portion N2 are formed close to each other to the extent not to protrude from the margin of the sheet bundle PT. Even with such a configuration, similar to the above-described various embodiments of the present disclosure, the sheet binding process can be simple and is quickly applied to various types of sheet bundle PT with a preferable binding force, even if a thickness of a sheet and the number of sheets constituting the sheet bundle PT vary.

Again, in this exemplary modification of the present disclosure, as a system to operate the second sheet binding unit 92, the same unit shifting device as described with reference to FIG. 4C is similarly utilized.

Hence, as described heretofore, according to one embodiment of the present disclosure, in the second sheet binding unit 92 of the sheet binding system 90, the first sheet binder 93 that includes a pair of dentate uneven portions 93*a*1 and 93*b*1 having a prescribed meshing depth is provided to conduct a sheet binding process by engaging the pair of dentate uneven portions 93*a*1 and 93*b*1 each other while sandwiching the sheet bundle PT therebetween to form a dentate unevenness in a thickness direction of the sheet bundle PT at a first sheet binding portion N1 of the sheet bundle PT. Also provided in the second sheet binding unit 92 of the sheet binding system 90 is a second sheet binder 94 also having a pair of dentate uneven portions 94*a*1 and 94*b*1 having a greater meshing depth than that of the first sheet binder 93 to form a denature unevenness in a thickness direction of the sheet bundle PT by engaging the pair of dentate uneven portions 94*a*1 and 94*b*1 each other while sandwiching the sheet bundle PT therebetween at a second sheet binding portion N2 different from the first sheet binding portion N1 of the sheet bundle PT. With this, the sheet binding process is applied to the sheet bundle PT not in the skew state by using appropriate sheet binding forces even if a thickness and the number of sheets of the sheet bundle PT vary.

According to one embodiment of the present disclosure, although it is applied to the first sheet binding system 90, the present disclosure can be naturally applied to the second sheet binding system 83 as well. Further, although one embodiment of the present disclosure is applied to the sheet binding system 90 that accommodates the second sheet binding unit 92 that applies the sheet binding process without using the metal needle in addition to the first sheet binding unit 91 that applies the sheet binding process with the metal needle, the present disclosure can be also naturally applied to a sheet binding system 90 that accommodates a sheet binding unit that only applies a sheet binding process without using the metal needle as well. Further, although one embodiment of the present disclosure is applied to the sheet binding system 90 installed in the post-processing machine 50 of a monochrome image forming apparatus 1, the present disclosure can be also naturally applied to a sheet binding system installed in a post-processing machine 50 of a color image forming apparatus as well. Further, although one embodiment of the present disclosure is applied to the sheet binding system 90 installed in the post-processing machine 50 of the image forming apparatus 1 that employs electrography, the present disclosure is not limited thereto and can be also naturally applied to a sheet binding system installed in a post-processing machine of a different type image forming apparatus, such as a stencil printing apparatus, an ink jet image forming apparatus, etc. Further, the present disclosure is not limited to the sheet binding system 90 included in the post-processing machine 50, but can be applied to a sheet binding unit as a standalone system as well. That is, for example, the present disclosure can be applied to a sheet binding system, to a sheet conveyance entrance 50*a* of which, a sheet cassette is attached, and in which a control panel to input an operation mode or the like is installed as well. Even in any one of situations, similar advantages as obtained in the above-described various embodiments of the present disclosure can be similarly obtained again.

Further, in the above-described various embodiments of the present disclosure, between the body of the image forming apparatus 1 and the post-processing machine 50, another post-processing machine (for example, a sheet folding device to fold a sheet P in a shape of letter Z) can also be installed as well. Further, although one embodiment of the present disclosure is applied to the post-processing machine 50 enabled to apply both the sheet binding process and the sheet folding process to the sheet P, the present disclosure is not limited to the above-described post-processing machine 50 and can be naturally applied to another post-processing machine that additionally performs a perforating process (e.g., a punching process), a post-processing machine that only applies the sheet binding process out of the above-described multiple processes, and a post-processing machine that applies combinations of the processes as well.

Further, although one embodiment of the present disclosure is applied to the sheet binding system 90, in which the widthwise direction (i.e., the direction in which the sheet binding units 91 and 92 shift) is perpendicular to the sheet conveying direction, the present disclosure can be naturally applied to a sheet binding system, in which the widthwise direction (i.e., the direction in which the sheet binding units 91 and 92 shift) corresponds to the sheet conveying direction as well. Even in any one of such modifications, similar advantages as obtained in the above-described various embodiments of the present disclosure can be similarly obtained again as long as the sheet binding process is applied to the sheet bundle PT stopping at the sheet biding position.

Further, although the second sheet binding unit 92 is configured to position at the two binding portions N1 and N2 in the corner of the sheet bundle PT as one embodiment of the present disclosure, the present disclosure is not limited thereto and these two binding portions N1 and N2 can be located in a trailing end of the sheet bundle PT (e.g., the multiple binding positions M1 to M3 in FIG. 4A) as well. In such a situation, these two binding portions N1 and N2 can be juxtaposed (i.e., placed side by side) in either the widthwise direction or a longitudinal direction of the sheet bundle PT. Further, although the second sheet binding unit 92 includes the pair of sheet binders 93 and 94 having different meshing depths H1 and H2 from each other as one embodiment of the present disclosure, the second sheet binding unit 92 includes three or more sheet binders having different meshing depths from each other as well. Even in any one of such situations, similar advantages as obtained in the above-described various embodiments of the present disclosure can be similarly obtained again.

Further, in the various embodiments of the present disclosure, the sheet includes all types of sheet as far as a toner image can be formed on a front surface thereof including, not to mention, a transfer sheet. Thus, the sheet bundle is defined as a bundle of these sheets, accordingly.

Further, the number, the position, and the shape of the element, the device, the unit, and the machine or the like are not limited to those as typically employed in the above-described various embodiments of the present disclosure, and can be any suitable number, a position, and a shape as well.

Numerous additional modifications and modifications of the present disclosure are possible in light of the above teachings. It is therefore to be understood that within the scope of the appended claims, the present disclosure may be practiced otherwise than as specifically described herein. For example, the sheet binding system is not limited to the above-described various embodiments and modifications may be made as appropriate. Further, the image forming apparatus is not limited to the above-described various embodiments and modifications may be altered as appropriate as well. Further, the method of binding a sheet bundle is not limited to the above-described various embodiments and modifications may be altered again as appropriate. For example, a step of the method of binding a sheet bundle can be altered as appropriate as well.

What is claimed is:

1. A sheet binding system comprising:

a sheet stacker configured to stack multiple sheets to generate a sheet bundle; and a sheet binding device configured to apply a sheet binding process to the sheet bundle stacked on the sheet stacker at two or more sheet binding positions on the sheet bundle, the sheet binding device including, a first pair of sheet binders including a first pair of dentate uneven sheet binding elements having a first dentate uneven sheet binding element and a second dentate uneven sheet binding element, the first pair of sheet binders configured to conduct a first sheet binding process of engaging the first dentate uneven sheet binding element and the second dentate uneven sheet binding element with each other by a first meshing depth while sandwiching the sheet bundle therebetween at a first sheet binding position of the two or more sheet binding positions on the sheet bundle to form a dentate unevenness on the sheet bundle in a thickness direction of the sheet bundle at the first sheet binding position, a second pair of sheet binders including a second pair of dentate uneven sheet binding elements having a third dentate uneven sheet binding element and a fourth dentate uneven sheet binding element, the second pair of sheet binders configured to conduct a second sheet binding process of engaging the third dentate uneven sheet binding element and the fourth dentate uneven sheet binding element with each other by a second meshing depth while sandwiching the sheet bundle therebetween at a second sheet binding position of the two or more sheet binding positions on the sheet bundle to form a dentate unevenness on the sheet bundle in a thickness direction of the sheet bundle at the second sheet binding position such that the second sheet binding position in which the second pair of sheet binders meshes to the second meshing depth is at a different position on the sheet bundle than the first sheet binding position which the first pair of sheet binders meshes to the first meshing depth, and a plurality of eccentric cams including a first eccentric cam and a second eccentric cam, the first eccentric cam configured to engage and disengage the first dentate uneven sheet binding element from the second dentate uneven sheet binding element, and the second eccentric cam configured to engage and disengage the third dentate uneven sheet binding element from the fourth dentate uneven sheet binding element.

2. The sheet binding system according to claim 1, wherein the sheet binding device further comprises:

an optical sensor configured to detect whether the sheet binding device is in a standby state in which both the first pair of sheet binders are separated and the second pair of sheet binders are separated.

3. The sheet binding system according to claim 2, wherein the sheet binding device further comprises:

a detection target disposed on a surface portion of one or more of the plurality of eccentric cams, wherein the optical sensor is configured to detect the standby state by optically detecting the detection target.

4. The sheet binding system according to claim 1, wherein the first sheet binding position and the second sheet binding position are located side-by-side with a gap in a corner of the sheet bundle such that the first sheet binding position is located closer to a square corner of an intersection of two sides forming the corner than the second sheet binding position.

5. The sheet binding system according to claim 1, where the first sheet binding position and the second sheet binding position are located side-by-side with a gap in a corner of the sheet bundle such that the first sheet binding position is located closer to a first side forming the corner of the sheet bundle than a second side forming the corner of the sheet bundle and the second sheet binding position is located closer to the second side than the first side.

6. The sheet binding system according to claim 1, further comprising:

a sheet aligner configured to align the sheet bundle stacked on the sheet stacker before the sheet binding device applies the sheet binding process to the sheet bundle stacked on the sheet stacker.

7. The sheet binding system according to claim 1, wherein the first pair of sheet binders is configured to conduct the first sheet binding process for a first sheet binding time, and the second pair of sheet binders is configured to conduct the second sheet binding process for a second sheet binding time such that the first sheet binding time is different than the second sheet binding time.

8. The sheet binding system according to claim 7, wherein the sheet binding device further includes:

an upper plate secured to a housing, the second dentate uneven sheet binding element of the first pair of sheet binders and the fourth dentate uneven sheet binding element of the second pair of sheet binders being on the upper plate;

a lower plate secured to the housing;

an arm configured to swing around a supporting shaft, the third dentate uneven sheet binding element of the second pair of sheet binders is on the arm, and the first dentate uneven sheet binding element of the first pair of sheet binders is held by the arm and movable up and down from and to the arm;

the first eccentric cam configured to rotate around an eccentric shaft;

a first link connected to the first dentate uneven sheet binding element of the first pair of sheet binders at one end of the first link and the lower plate at another end of the first link;

a first connecting rod connected to a node of the first link at one end of the first connecting rod and the first eccentric cam at another end of the first connecting rod;

the second eccentric cam configured to rotate around the eccentric shaft;

a second link connected to the arm at one end of the second link and the lower plate at another end of the second link;

a second connecting rod connected to a node of the second link at one end of the second connecting rod and the second eccentric cam at another end of the second connecting rod; and a driving motor configured to rotate the first eccentric cam and the second eccentric cam in a direction, wherein wherein a controller differentiates rotational phases of the first eccentric cam and the second eccentric cam from each other such that the first sheet binding time is different than the second sheet binding time.

9. The sheet binding system according to claim 1, further comprising:

a unit shifting device configured to move the sheet binding device between a retracted position and an extended position corresponding to the two or more sheet binding positions on the sheet bundle.

10. The sheet binding system according to claim 9, wherein the unit shifting device is configured to move the sheet binding device such that an extended position of the first pair of sheet binders is different from an extended position of the second pair of sheet binders with respect a corner of the sheet bundle.

11. The sheet binding system according to claim 1, wherein the first pair of sheet binders and the second pair of sheet binders are arranged side-by-side with respect to the direction in which the first pair of dentate uneven sheet binding elements and the second pair of dentate uneven sheet binding elements extend such that the first sheet binding position is associated with a first side of the sheet bundle and the second sheet binding position is associated with a second side of the sheet bundle, the first side of the sheet bundle being a different side of the sheet bundle from the second side of the sheet bundle.

12. The sheet binding system according to claim 1, wherein the first pair of sheet binders and the second pair of sheet binders are arranged side-by-side with respect to a direction in which the first pair of dentate uneven sheet binding elements and the second pair of dentate uneven sheet binding elements extend.

13. An image forming apparatus comprising:

a toner image forming device to form a toner image on a sheet;

the sheet binding system according to claim 1; and a sheet ejector to eject the sheet bearing the toner image into the sheet binding system.

14. A method of binding a sheet bundle using a sheet binding system, the sheet binding system including a sheet stacker configured to stack multiple sheets to generate the sheet bundle, a sheet binding device configured to apply a sheet binding process to the sheet bundle stacked on the sheet stacker at two or more sheet binding positions on the sheet bundle, and a unit shifting device configured to move the sheet binding device, the sheet binding device including a first pair of sheet binders, a second pair of sheet binders, and a plurality of eccentric cams including a first eccentric cam and a second eccentric cam, the first pair of sheet binders including a first pair of dentate uneven sheet binding elements having a first dentate uneven sheet binding element and a second dentate uneven sheet binding element, and the second pair of sheet binders including a second pair of dentate uneven sheet binding elements having a third dentate uneven sheet binding element and a fourth dentate uneven sheet binding element, the method comprising:

stacking multiple sheets on the sheet stacker to generate the sheet bundle;

performing one or more of, a first sheet binding process of engaging the first dentate uneven sheet binding element and the second dentate uneven sheet binding element with each other by a first meshing depth while sandwiching the sheet bundle therebetween at a first sheet binding position of the two or more sheet binding positions on the sheet bundle to form a dentate unevenness on the sheet bundle in a thickness direction of the sheet bundle at the first sheet binding position, and a second sheet binding process of engaging the third dentate uneven sheet binding element and the fourth dentate uneven sheet binding element with each other by a second meshing depth while sandwiching the sheet bundle therebetween at a second sheet binding position of the two or more sheet binding positions on the sheet bundle to form a dentate unevenness on the sheet bundle in a thickness direction of the sheet bundle at the second sheet binding position such that the second sheet binding position in which the second pair of sheet binders meshes to the second meshing depth is at a different position on the sheet bundle than the first sheet binding position which the first pair of sheet binders meshes to the first meshing depth;

selectively disengaging, via the first eccentric cam, the first dentate uneven sheet binding element from the second dentate uneven sheet binding element; and selectively disengaging, via the second eccentric cam, the third dentate uneven sheet binding element from the fourth dentate uneven sheet binding element.

15. The method according to claim 14, wherein the performing performs the first sheet binding process for a first sheet binding time, and performs the first sheet binding process for a second sheet binding time, and the method further comprises:

adjusting an amount of time associated with each of the first sheet binding time and the second sheet binding time.

16. The method according to claim 14, further comprising:

detecting, via an optical sensor, whether the sheet binding device is in a standby state in which both the first pair of sheet binders are separated and the second pair of sheet binders are separated.

17. The method according to claim 16, wherein the sheet binding device further includes a detection target on a surface portion of one or more of the plurality of eccentric cams, and the method further comprises:

detecting the standby state by optically detecting the detection target.

18. The method according to claim 14, further comprising:

moving one or more of the first pair of sheet binders and the second pair of sheet binders from a retracted position to an extended position corresponding to the two or more sheet binding positions on the sheet bundle.

19. The method according to claim 18, wherein the moving moves the sheet binding device such that an extended position of the first pair of sheet binders is different from an extended position of the second pair of sheet binders with respect a corner of the sheet bundle.

20. The method according to claim 14, wherein the first pair of sheet binders and the second pair of sheet binders are arranged side-by-side with respect to the direction in which the first pair of dentate uneven sheet binding elements and the second pair of dentate uneven sheet binding elements extend such that the first sheet binding position is associated with a first side of the sheet bundle and the second sheet binding position is associated with a second side of the sheet bundle, the first side of the sheet bundle being a different side of the sheet bundle from the second side of the sheet bundle.

21. The method according to claim 14, wherein the first pair of sheet binders and the second pair of sheet binders are arranged side-by-side with respect to a direction in which the first pair of dentate uneven sheet binding elements and the second pair of dentate uneven sheet binding elements extend.

22. A sheet binding system comprising:

a sheet stacker configured to stack multiple sheets to generate a sheet bundle; and a sheet binding device configured to apply a sheet binding process to the sheet bundle stacked on the sheet stacker at two or more sheet binding positions on the sheet bundle, the sheet binding device including, a first pair of sheet binders including a first pair of dentate uneven sheet binding elements having a first dentate uneven sheet binding element and a second dentate uneven sheet binding element, the first pair of sheet binders configured to conduct a first sheet binding process of engaging the first dentate uneven sheet binding element and the second dentate uneven sheet binding element with each other by a first meshing depth while sandwiching the sheet bundle therebetween at a first sheet binding position of the two or more sheet binding positions on the sheet bundle for a first sheet binding time to form a dentate unevenness on the sheet bundle in a thickness direction of the sheet bundle at the first sheet binding position, a second pair of sheet binders including a second pair of dentate uneven sheet binding elements having a third dentate uneven sheet binding element and a fourth dentate uneven sheet binding element, the second pair of sheet binders configured to conduct a second sheet binding process of engaging the third dentate uneven sheet binding element and the fourth dentate uneven sheet binding element with each other by a second meshing depth while sandwiching the sheet bundle therebetween at a second sheet binding position of the two or more sheet binding positions on the sheet bundle for a second sheet binding time to form a dentate unevenness on the sheet bundle in a thickness direction of the sheet bundle at the second sheet binding position such that the second sheet binding position in which the second pair of sheet binders meshes to the second meshing depth is at a different position on the sheet bundle than the first sheet binding position which the first pair of sheet binders meshes to the first meshing depth, the second sheet binding time being different than the first sheet binding time, an upper plate secured to a housing, the second dentate uneven sheet binding element of the first pair of sheet binders and the fourth dentate uneven sheet binding element of the second pair of sheet binders being on the upper plate, a lower plate secured to the housing, an arm configured to swing around a supporting shaft, the third dentate uneven sheet binding element of the second pair of sheet binders is on the arm, and the first dentate uneven sheet binding element of the first pair of sheet binders is held by the arm and movable up and down from and to the arm, a first eccentric cam configured to rotate around an eccentric shaft, a first link connected to the first dentate uneven sheet binding element of the first pair of sheet binders at one end of the first link and the lower plate at another end of the first link, a first connecting rod connected to a node of the first link at one end of the first connecting rod and the first eccentric cam at another end of the first connecting rod, a second eccentric cam configured to rotate around the eccentric shaft, a second link connected to the arm at one end of the second link and the lower plate at another end of the second link, a second connecting rod connected to a node of the second link at one end of the second connecting rod and the second eccentric cam at another end of the second connecting rod, and a driving motor configured to rotate the first eccentric cam and the second eccentric cam in a direction, wherein wherein a controller differentiates rotational phases of the first eccentric cam and the second eccentric cam from each other such that the first sheet binding time is different than the second sheet binding time.

* * * * *